US012127587B2

(12) United States Patent
Liang

(10) Patent No.: US 12,127,587 B2
(45) Date of Patent: Oct. 29, 2024

(54) DUAL VAPORIZER

(71) Applicant: iVision Tech Inc., Middletown, DE (US)

(72) Inventor: Xiao Liang, Arcadia, CA (US)

(73) Assignee: iVision Tech Inc.

( * ) Notice: Subject to any disclaimer, the term of this patent is extended or adjusted under 35 U.S.C. 154(b) by 556 days.

(21) Appl. No.: 17/528,106

(22) Filed: Nov. 16, 2021

(65) Prior Publication Data

US 2023/0148661 A1 May 18, 2023

(51) Int. Cl.

| | |
|---|---|
| ***A24F 40/30*** | (2020.01) |
| ***A24F 40/10*** | (2020.01) |
| ***A24F 40/42*** | (2020.01) |
| ***A24F 40/48*** | (2020.01) |
| ***A24F 40/51*** | (2020.01) |
| ***A24F 40/60*** | (2020.01) |

(52) U.S. Cl.

CPC ..... *A24F 40/30* (2020.01); *A24F 40/10* (2020.01); *A24F 40/42* (2020.01); *A24F 40/48* (2020.01); *A24F 40/51* (2020.01); *A24F 40/60* (2020.01)

(58) Field of Classification Search

None

See application file for complete search history.

(56) References Cited

U.S. PATENT DOCUMENTS

| | | | | |
|---|---|---|---|---|
| 2018/0360125 | A1* | 12/2018 | James | A24F 40/40 |
| 2019/0174827 | A1* | 6/2019 | Fernando | H01R 4/48 |
| 2020/0229492 | A1* | 7/2020 | Wilson | A24F 40/46 |
| 2023/0000156 | A1* | 1/2023 | Griffin | A24F 40/42 |

* cited by examiner

*Primary Examiner* — Christopher M Rodd
*Assistant Examiner* — Daniel Edward Vakili
(74) *Attorney, Agent, or Firm* — Clement Cheng

(57) ABSTRACT

An electronic vaporizer has an upper section that has an upper housing. The upper section also retains a right cartridge. The right cartridge is retained within the upper housing. The right cartridge further includes a right heater, a right tank, and a right chimney. A cartridge is retained within the upper housing. The left cartridge further includes a left heater, a left tank and a left chimney. The left cartridge is parallel to the right cartridge. A lower section has a lower housing. A battery is retained in the lower housing. The battery is configured to activate the right heater and the left heater.

11 Claims, 10 Drawing Sheets

DUAL VAPORIZER

FIELD OF THE INVENTION

The present invention is in the field of electronic vaporizers.

DISCUSSION OF RELATED ART

Electronic vaporizers have become popular as smokers avoid cigarettes due to health problems with inhaling tar. As electronic vaporizers proliferate, more flavors of vapor oil have become popular.

SUMMARY OF THE INVENTION

An electronic vaporizer has an upper section that has an upper housing. The upper section also retains a right cartridge. The right cartridge is retained within the upper housing. The right cartridge further includes a right heater, a right tank, and a right chimney. A cartridge is retained within the upper housing. The left cartridge further includes a left heater, a left tank and a left chimney. The left cartridge is parallel to the right cartridge. A lower section has a lower housing. A battery is retained in the lower housing. The battery is configured to activate the right heater and the left heater.

The right airflow sensor and left airflow sensor sense air intake and activate the respective heater. A controller such as a printed circuit board, microcontroller or central processing unit can be used for electronic control. The right airflow sensor and the left airflow sensor are preferably mounted in the lower section. A right air intake is formed in the lower housing. A left air intake is formed in the lower housing.

A USB port can be mounted to the lower housing. A control button activates a control button switch mounted in the lower housing because the control button is aligned to the control button switch. An interface frame mounted to the lower section. The interface frame retains a first right spring-loaded electrical contact, and a second right spring-loaded electrical contact. The interface frame further retains a first a left spring loaded electrical contact, and a second left spring-loaded electrical contact.

The right cartridge has a first right cartridge contact making electrical contact to the first right spring-loaded electrical contact, and a second right cartridge contact making electrical contact to the second right spring-loaded electrical contact. The left cartridge has a first left cartridge contact making electrical contact to the first left spring-loaded electrical contact, and a second left cartridge contact making electrical contact to the second left spring-loaded electrical contact.

The right cartridge fits into a right socket and the left cartridge fits into a left socket. The right socket and the left socket are formed in the upper housing. The right socket has a right socket latch spring that retains the right cartridge at a right socket latch slot formed on the right cartridge. The left socket has a left socket latch spring that retains the left cartridge at a left socket latch slot formed on the left cartridge. A right cartridge metal frame is attached to the right cartridge, and a left cartridge metal frame is attached to the left cartridge. The right cartridge metal frame releasably connects to a first right latch magnet, and a second right latch magnet. The left cartridge metal frame releasably connects to a first left latch magnet and a second left latch magnet.

The right chimney exhausts against a right insulator, then turning right to a right mouthpiece opening, wherein the left chimney exhausts against a left insulator, then turning left to a left mouthpiece opening. The right cartridge has a first right intake passage that extends upwardly, and a second right intake passage that extends upwardly. The first right intake passage leads to a first right bend back passage which bends downwardly toward the right chimney. The second right intake passage leads to a second right bend back passage which bends downwardly toward the right chimney. The first right bend back passage leads to a first right pre-chamber passage. The second right bend back passage leads to a second right prechamber passage. The first right prechamber passage bends upwardly to the right chimney. The second right prechamber passage bends upwardly to the right chimney.

The left cartridge has a first left intake passage that extends upwardly, and a second left intake passage that extends upwardly. The first left intake passage leads to a first left bend back passage which bends downwardly toward the left chimney. The second left intake passage leads to a second left bend back passage which bends downwardly toward the left chimney. The first left bend back passage leads to a first left pre-chamber passage. The second left bend back passage leads to a second left prechamber passage. The first left prechamber passage bends upwardly to the left chimney, wherein the second left prechamber passage bends upwardly to the left chimney. The first right prechamber indent extends downwardly from the first right prechamber passage, and a second right prechamber indent extends downwardly from the second right prechamber passage. A first left prechamber indent extends downwardly from the first left prechamber passage, and a second left prechamber indent extends downwardly from the second left prechamber passage.

Figure 1:
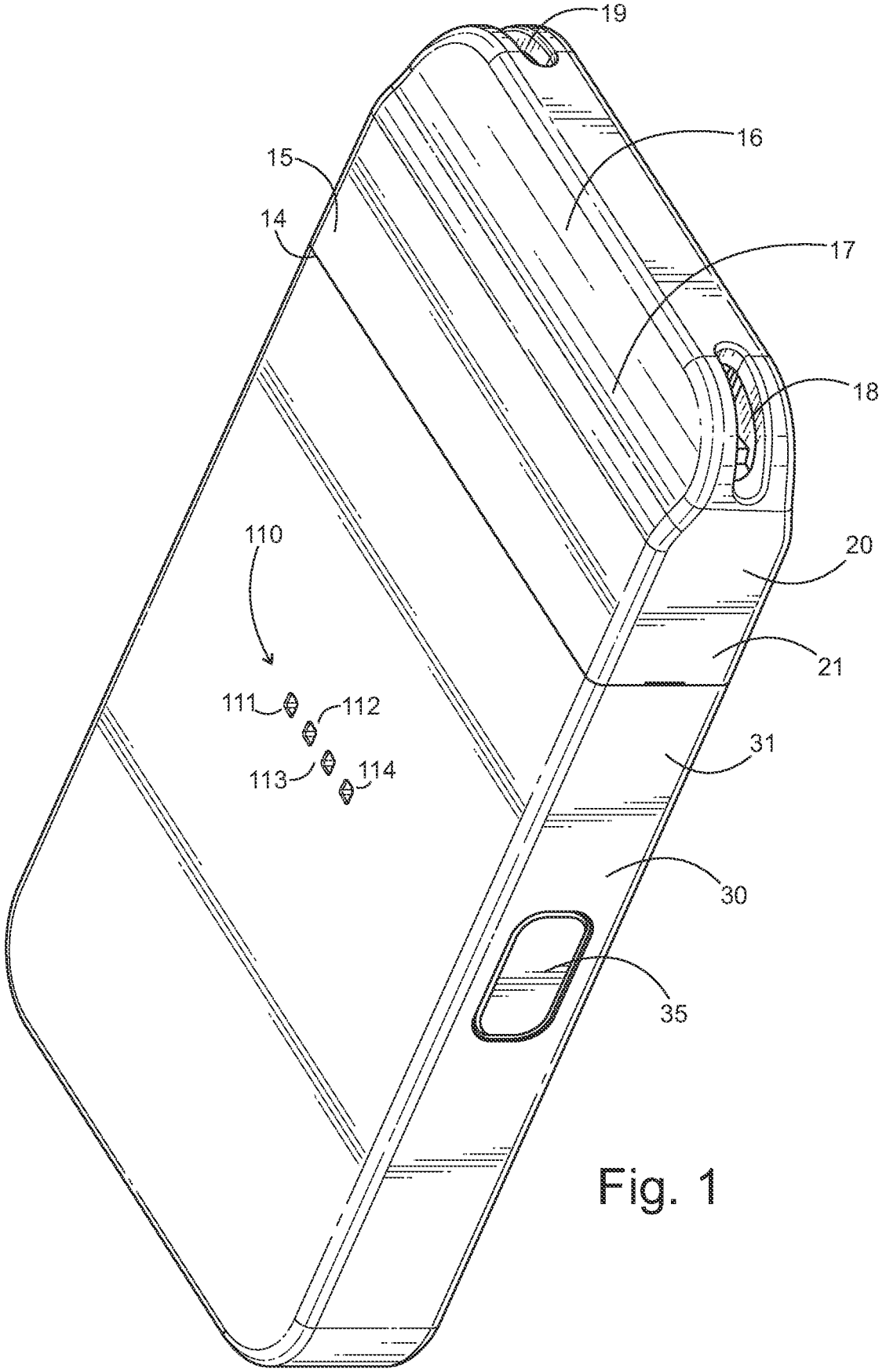
FIG. 1 is a perspective view of the present invention.
Figure 2:
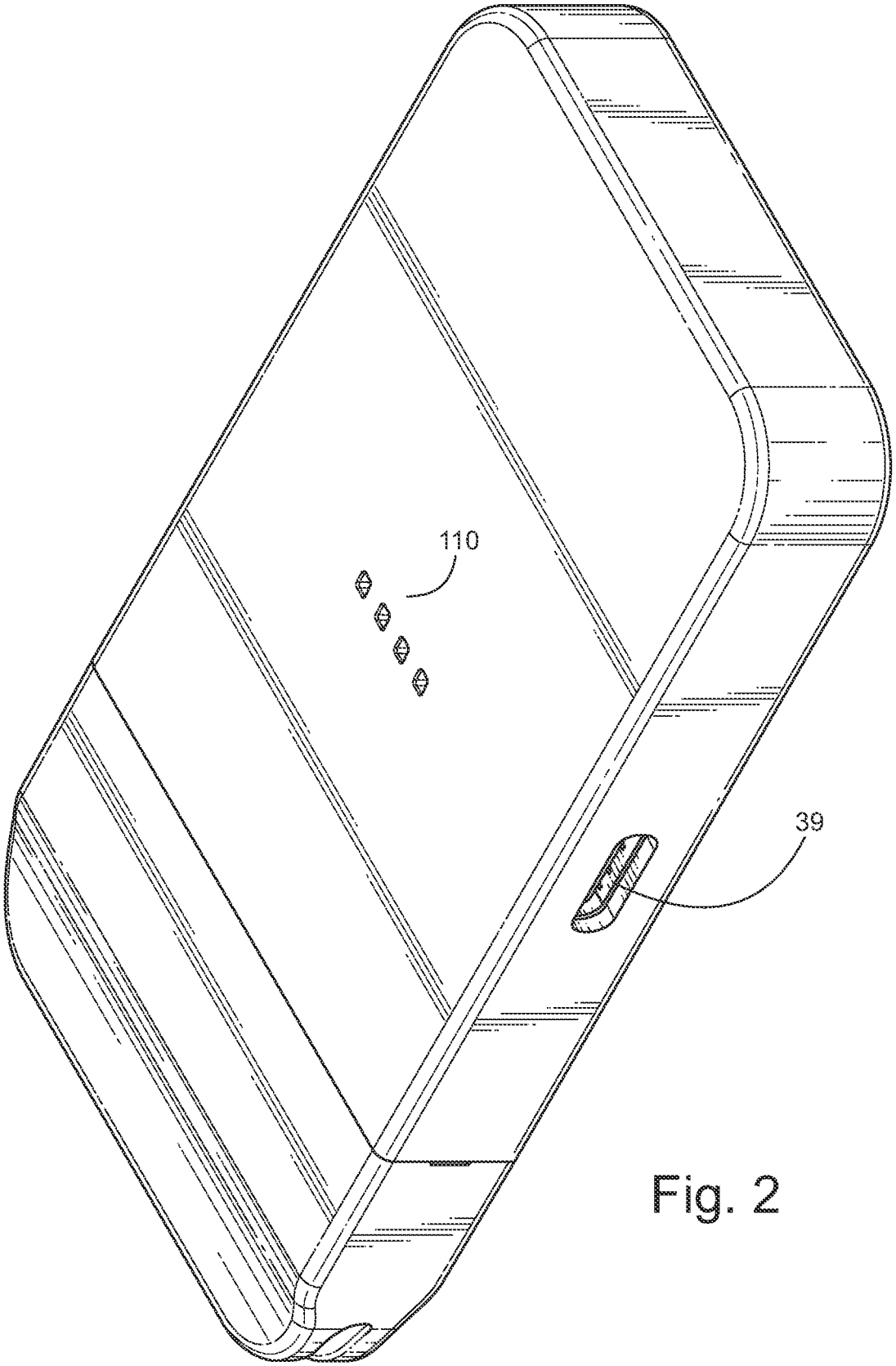
FIG. 2 is a perspective view of the present invention.
Figure 3:
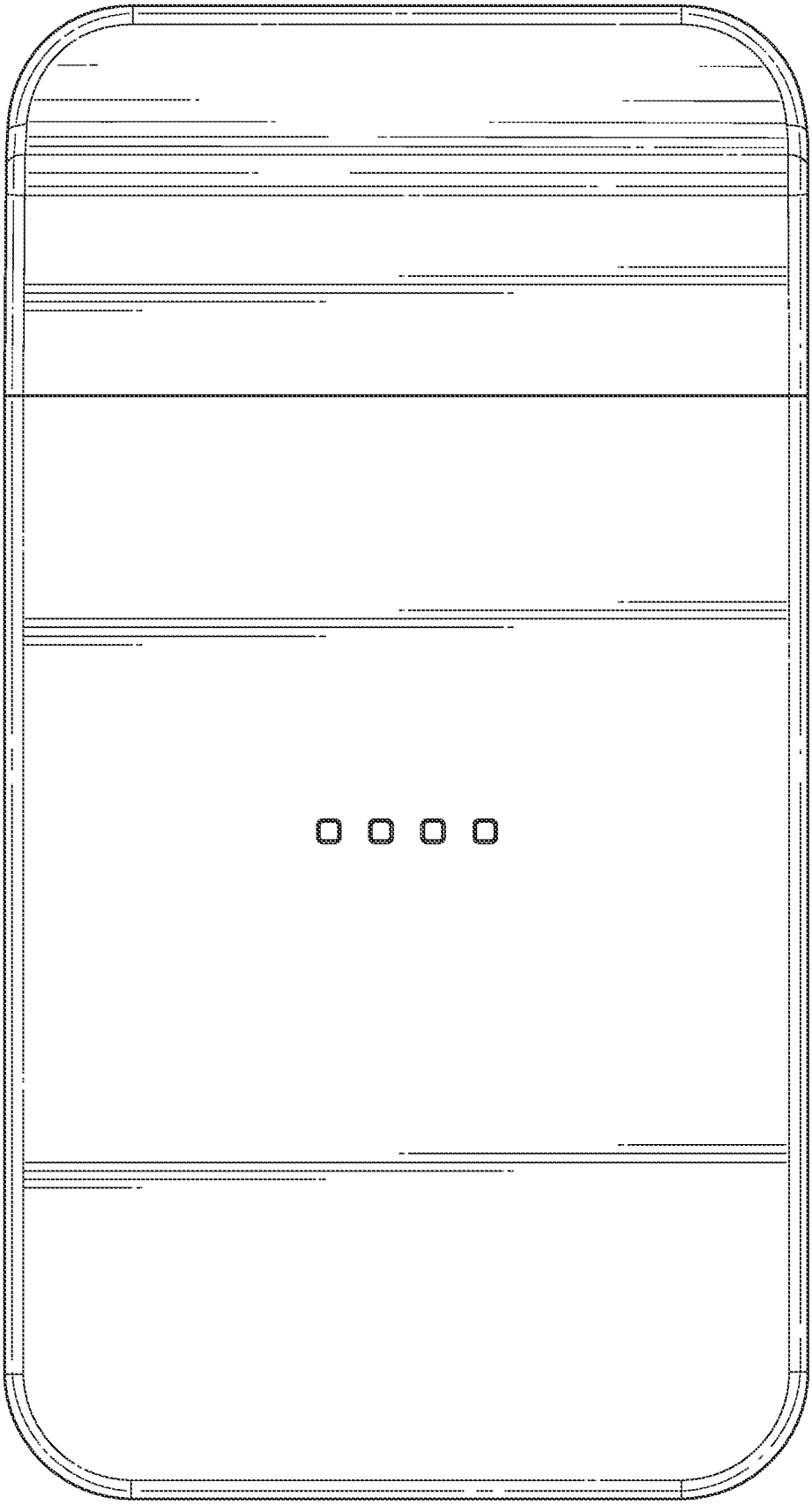
FIG. 3 is a front view of the present invention.
Figure 4:
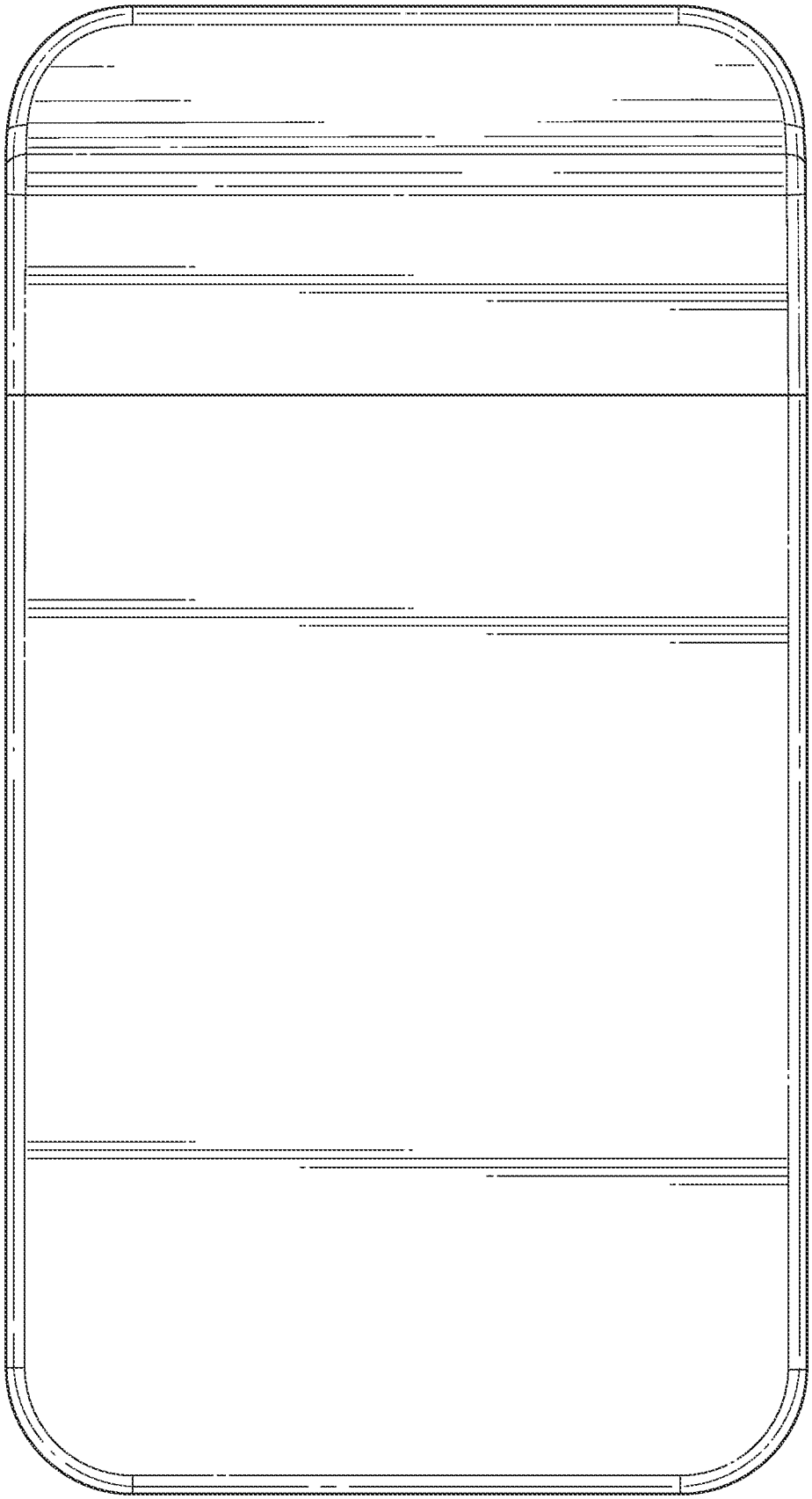
FIG. 4 is a rear view of the present invention.
Figure 5:
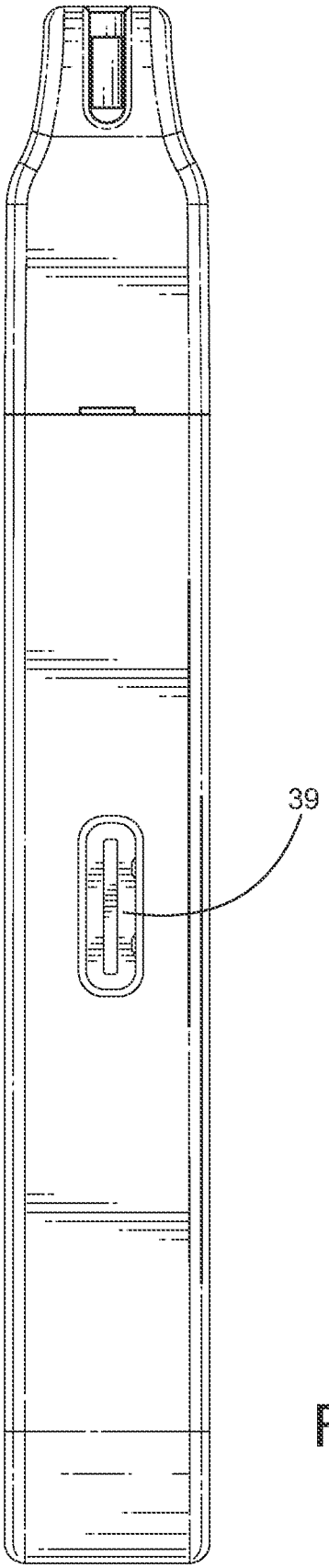
FIG. 5 is a left side view.
Figure 6:
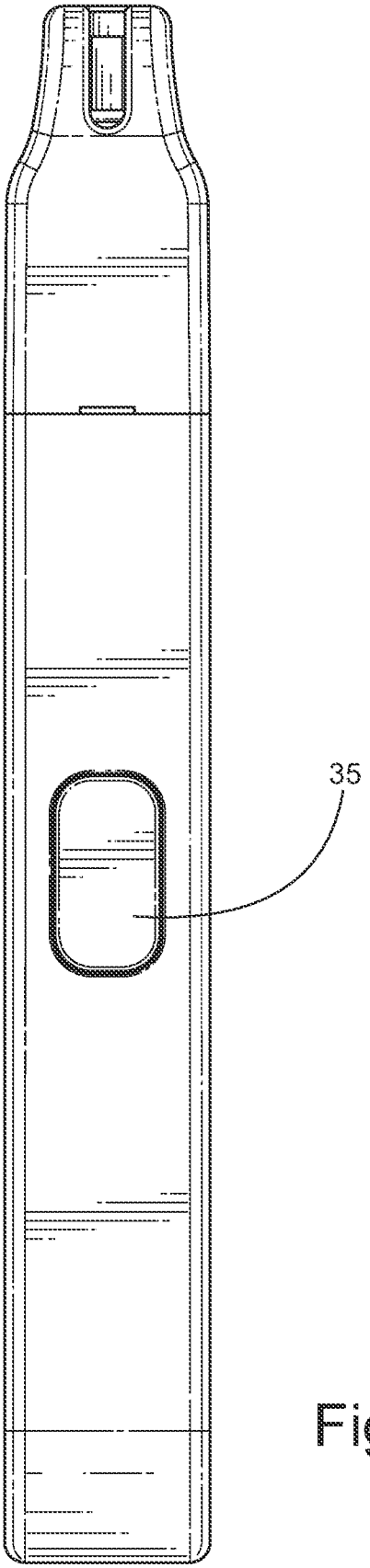
FIG. 6 is a right side view of the present invention.
Figure 7:
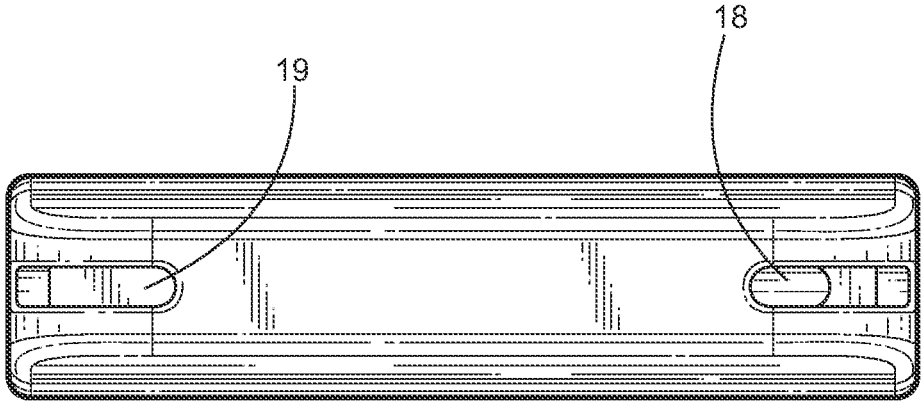
FIG. 7 is a top view.
Figure 8:
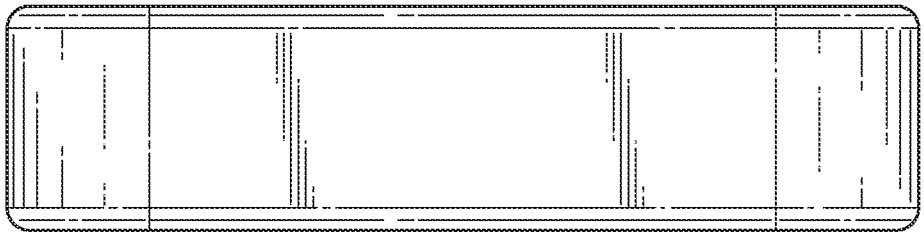
FIG. 8 is a bottom view.

The following call out list of elements can be a useful guide in referencing the claim elements of the numbers of the drawings.

12 Right Cartridge
13 Left Cartridge
14 Housing Interface
15 Wide Mouthpiece Portion
16 Narrow Mouthpiece Portion
17 Mouthpiece Shoulder
18 Right Mouthpiece Opening
19 Left Mouthpiece Opening
20 Upper Section
21 Upper Housing
22 Right Tank
23 Right Tank Oil
24 Left Tank
25 Left Tank Oil
26 Right Chimney

27 Left Chimney
28 Right Heater
29 Left Heater
30 Lower Section
31 Lower Housing
32 Printed Circuit Board
33 Left Airflow Sensor
34 Right Airflow Sensor
35 Control Button
36 Button Switch
37 Battery
38 Lower Frame
39 Universal Serial Bus
40 Interface Frame
41 Interface Gasket
42 First Right Latch Magnet
43 Second Right Latch Magnet
44 First Left Latch Magnet
45 Second Left Latch Magnet
46 First Left Spring Loaded Electrical Contact
47 Second Left Spring Loaded Electrical Contact
48 First Right Spring Loaded Electrical Contact
49 Second Right Spring Loaded Electrical Contact
50 Right Gasket
51 Right Plug
52 Right Fill Port
53 Left Gasket
54 Left Plug
55 Right Chimney Port
56 Left Chimney Port
57 Right Insulator
58 Left Insulator
59 Left Fill Port
60 Metal Frame Assembly
61 Right Cartridge Metal Frame
62 Left Cartridge Metal Frame
63 Right Metal Frame Airflow Opening
64 Left Metal Frame Airflow Opening
65 First Right Cartridge Contact
66 Second Right Cartridge Contact
67 First Left Cartridge Contact
68 Second Left Cartridge Contact
70 Socket
71 Right Socket
72 Left Socket
73 Right Socket Latch Slot
74 Left Socket Latch Slot
75 Right Socket Latch Spring
76 Left Socket Latch Spring
80 Airflow
81 Right Interface Frame Air Intake Airflow
82 Left Interface Frame Air Intake Airflow
83 Right Interface Frame Air Intake
84 Left Interface Frame Air Intake
90 First Bend Back Passage
91 First Left Prechamber Passage
92 First Right Prechamber Passage
93 Second Right Prechamber Passage
94 Second Left Prechamber Passage
95 Second Right Bend Back Passage
96 Second Left Bend Back Passage
97 Second Right Intake Passage
98 Second Left Intake Passage
99 Right Chimney Passage
100 Left Chimney Passage
101 Right Chimney Exit Passage
102 Left Chimney Exit Passage
103 Right Chimney Exhaust
104 Left Chimney Exhaust
105 First Right Prechamber Indent
106 Second Right Prechamber Indent
107 Second Left Prechamber Indent
110 Indicator Lights
111 First LED
112 Second LED
113 Third LED
114 Fourth LED

DETAILED DESCRIPTION OF THE PREFERRED EMBODIMENT

As seen in FIGS. 1-8, the electronic vaporizer has an upper portion and a lower portion. The upper portion retains a right cartridge 12 and a left cartridge 13. The upper portion has a mouthpiece with a right mouthpiece opening 18 and a left mouthpiece opening 19. The mouthpiece has a wide mouthpiece portion 15 below a narrow mouthpiece portion 16 with a mouthpiece shoulder 16. The upper portion of the housing and the lower portion of the housing meet at a housing interface 14. The lower portion of the housing has a USB connection 39. The lower portion of the housing also has indicator lights 110. The indicator lights include a first LED 111, a second LED 112, a third LED 113, and a fourth LED 114. The general exterior of the device shows that the upper section 20 and the lower section 30 meet at a flush interface.

Figure 9:
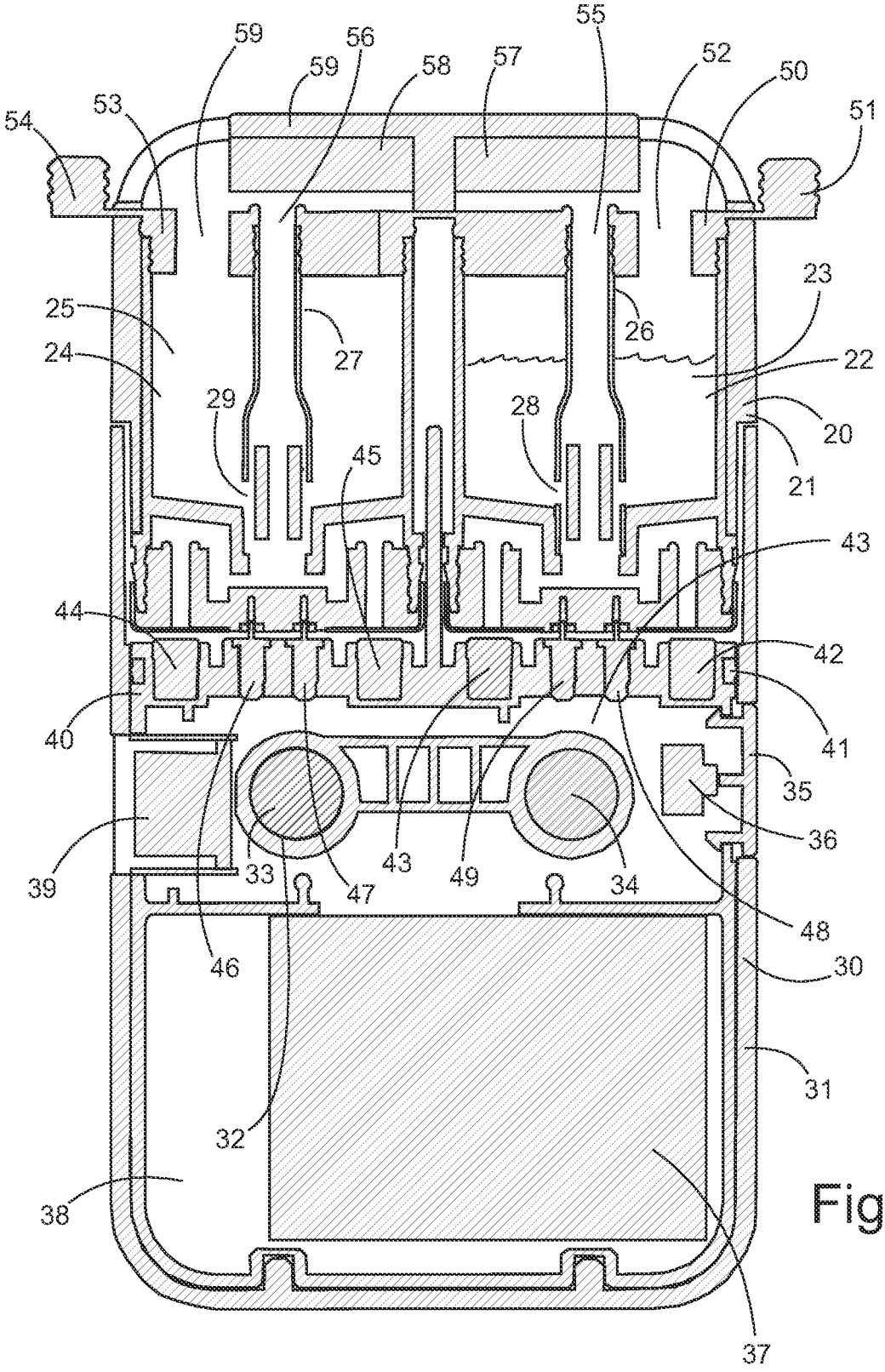
FIG. 9 is a cross section view.
Figure 10:
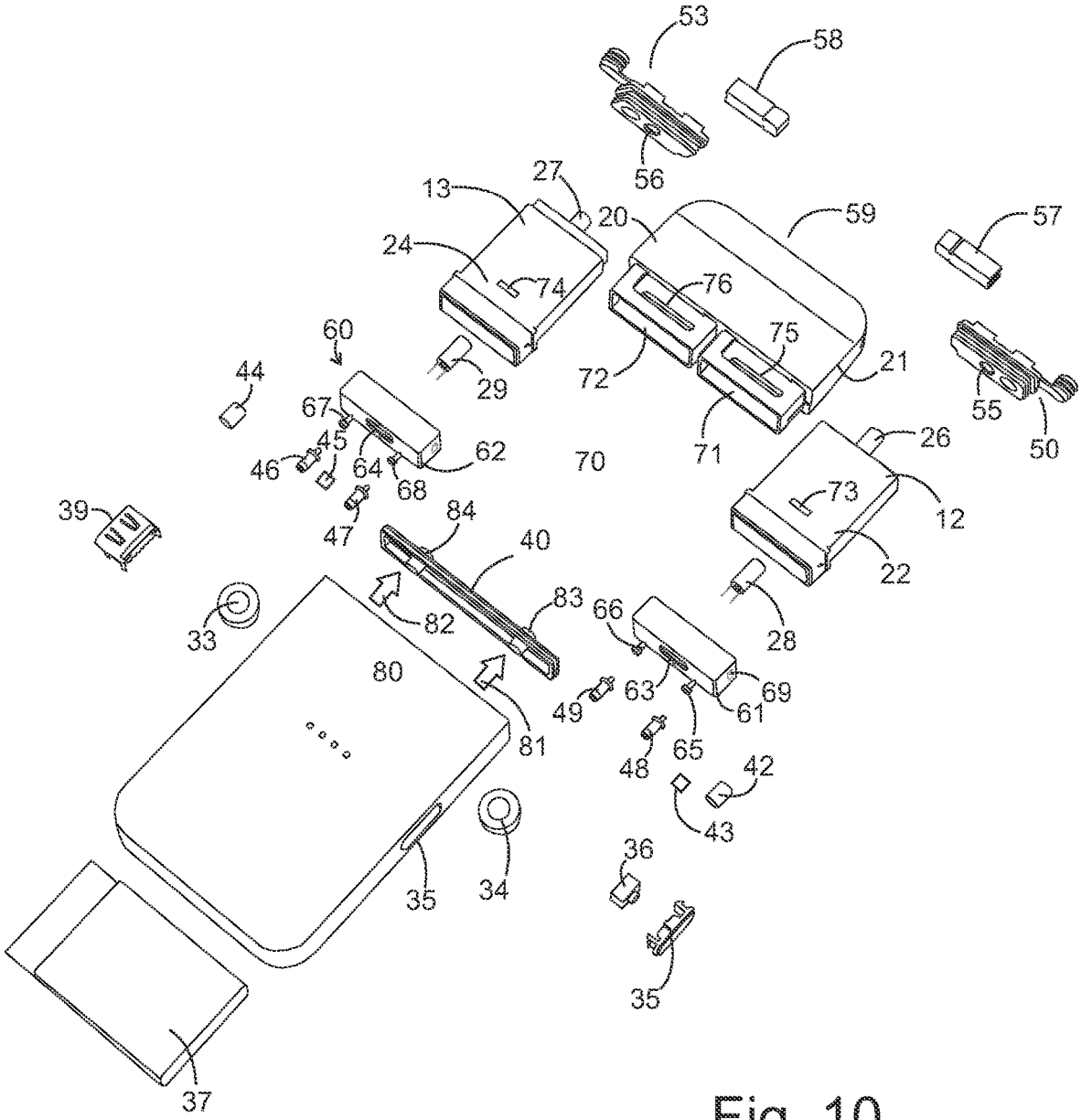
FIG. 10 is an exploded perspective view.

As seen in FIGS. 9-10, the upper section 20 has an upper housing 21, and the lower section 30 has a lower housing 31. The lower section 30 has a lower frame 38 mounted to the inside of the lower housing 31. The lower frame retains the battery 37. The battery 37 powers a right airflow sensor 34 and a left airflow sensor 33. The button switch 36 and USB socket 39 are also mounted to the lower section 30. USB stands for uniform serial bus which allows charging and data transfer. The USB socket 39 and control button 35 can be mounted to a printed circuit board 32. The button switch 36 is activated via the control button 35 which is slidingly mounted to a control button opening in the lower frame 38.

The interface frame 40 is mounted in an upper portion of the lower section 30. The interface frame 40 retains a first left spring loaded electrical contact 46 and a second left spring loaded electrical contact 47 on a left side of the interface frame 40. The interface frame 40 also retains a first right spring loaded electrical contact 48 and a second right spring loaded electrical contact 49 on the right side of the interface frame 40. The four spring loaded electrical contacts electrically connect to the cartridge contacts. The first right cartridge contact 65 makes electrical connection with the first right spring loaded electrical contact 48, and the second right cartridge contact 66 makes electrical connection with the second right spring loaded electrical contact 49. Similarly, the first left cartridge contact 67 makes electrical contact with the second left spring loaded electrical contact 47, and the first left spring loaded electrical contact 46 makes electrical contact with the second left cartridge contact 68. The right cartridge metal frame 61 retains the first right cartridge contact 65 and the second right cartridge contact 66. Similarly, the left cartridge metal frame 62 retains the first left cartridge contact 67 and the second left cartridge contact 68.

The electrical contacts power a right heater 28 and a left heater 29. The right heater 28 is in fluid flow with a right chimney 26, and the left heater 29 is in fluid flow with a left chimney 27. The right chimney 26 has exhaust that passes through a right chimney port 55, and the left chimney 27 has a fluid flow that passes through the left chimney port 56. The right cartridge 12 has a right tank 22 fillable with right tank oil 23 through a right fill port 52. A right plug 51 can close the right fill port 52. The right fill port 52 is located below the right mouthpiece opening. Similarly, the left cartridge 13 has a left tank 24 that receives the left tank oil 25 through a left fill port 59. The left fill port 59 can be closed using a left plug 54. The upper section 20 having an upper housing 21 retains the cartridges.

The cartridges have a right cartridge metal frame 61 and a left cartridge metal frame 62. The right cartridge metal frame 61 has a right metal frame airflow opening 63, and the left cartridge metal frame 62 has a left metal frame airflow opening 64. The right cartridge metal frame 61 magnetically latches to the first right latch magnet 42, and the second right latch magnet 43. The left cartridge metal frame 62 magnetically latches to the first left latch magnet 44 and the second left latch magnet 45. The latch magnets are mounted to the left and right of the intake passages.

The right heater 28 receives the flow of oil from the right tank oil 23 and vaporizes it so that it passes through the right chimney port 55. Similarly, the left heater 29 receives a flow of left tank oil 25 which vaporizes so that it passes through the left chimney 27.

As seen in FIG. 10, the upper section 20 detaches from the lower section 30 exposing the cartridges. The pair of cartridges is arranged with a right cartridge and a left cartridge. The cartridges are flat and elongated such that the upper section 20 and the lower section 30 are flat and elongated. The cartridges have an air intake while limiting leaking of oil. The cartridges fit into the socket 70. The right cartridge fits into the right socket 71, and the left cartridge fits into the left socket 72. As the exhaust exits from the right chimney port 55, it passes along a lower surface of a right insulator 57, and as exhaust exits from the left chimney port 56, it passes along a lower surface of a left insulator 58. The right gasket 50 has a right chimney port 55, and the left gasket 53 has a left chimney port 56.

The right socket 71 has a right socket latch spring 75 that engages a right socket latch slot 73, thereby retaining the right cartridge. Similarly, the left socket 72 has a left socket latch spring 76 that engages a left socket latch slot 74 thereby retaining the left cartridge. The metal frame assembly 60 includes a right cartridge metal frame 61 and a left cartridge metal frame 62. The right cartridge metal frame 61 can be crimped to a lower portion of the right cartridge, and the left cartridge metal frame 62 can be crimped to a lower portion of the left cartridge. Accordingly, the upper housing 21 has a pair of sockets 70 that removably receive a pair of cartridges. The right socket latch spring 75 and the left socket latch spring 76 can be formed as leaf springs on a plastic injection molded upper housing 21.

The left interface frame air intake airflow 82 passes through the left metal frame airflow opening 64 of the left cartridge metal frame 62 and the right interface frame air intake airflow 81 passes through the right metal frame airflow opening 65 of the right cartridge metal frame 61. Airflow passes across the sensors, then through the interface frame 40, then into the cartridges, through the cartridge chimneys, and then out of the chimney ports to the mouthpieces.

Figure 11:
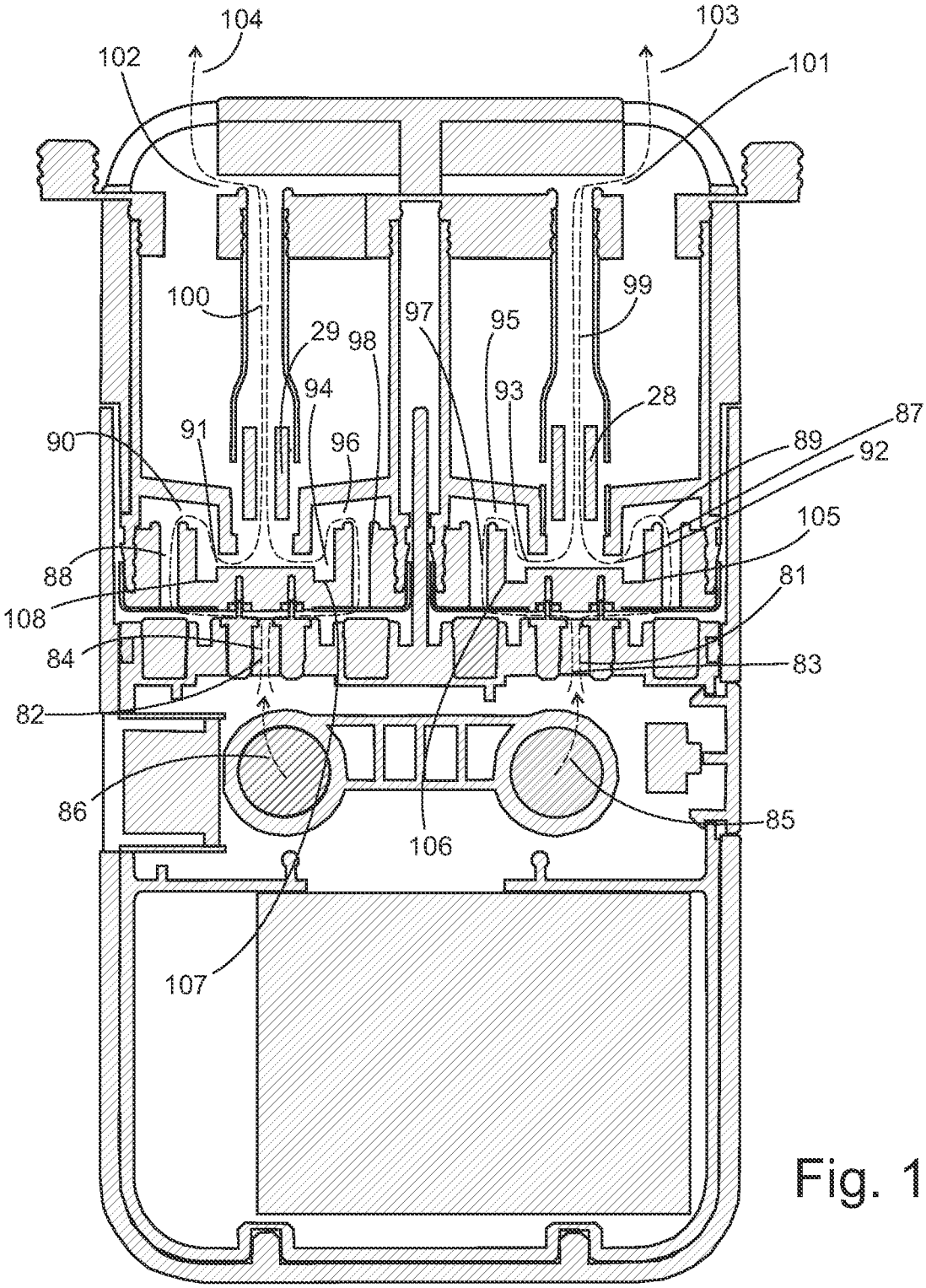
FIG. 11 is a cross section view.

As seen in FIG. 11, the airflow diagrams shows that the right air intake flow 85 passes across the right airflow sensor, while the left air intake flow 86 passes across the left airflow sensor. The right air intake flow 85 then passes through as the right interface frame air intake airflow 81 through the right metal frame airflow opening 63. Similarly, the left intake flow 86 passes through as the left interface frame air intake airflow 82 through the left metal frame airflow opening 64. From the metal frame airflow openings, the air splits into a pair of paths for each cartridge.

The right cartridge has a first right intake passage 87, and a second right intake passage 97. The left cartridge has a first left intake passage 88, and a second left intake passage 98. The first right intake passage connects to a first right bend back passage 89 that turns the airflow from an upward flow to a downward flow. The downward flow then turns back upward at a first right prechamber passage 92. Similarly, the second right intake passage 97 is generally vertical and receives airflow through the metal frame. The generally vertical airflow of the second right intake passage 97 leads to the second right bend back passage 95 where the upward airflow turns downward to a second right prechamber passage 93. The second right prechamber passage 93 turns the downward airflow back to an upward airflow. Thus, each of the air intakes on the right cartridge have an upward airflow, then a downward U-shaped bend to an upward U-shaped bend. In all, each airflow passage has five right angle bends. The pair of airflows and the pair of airflow passages are preferably symmetrical and begin distally at a lower end of the cartridge closer to the lower section. The airflows then converge at the right heater 28.

The left intake passages include the first left intake passage 88 which leads upward to the first left bend back passage 90 that bends downwardly toward the chimney. The first left bend back passage 90 leads to a first left prechamber passage which bends upwardly to deliver the airflow to the left heater 29. The left intake passages are thus similar to the right intake passages. The second left intake passage 98 receives air passing through the interface frame 40, and directs it upwardly to a second left bend back passage 96 which directs the air downwardly to a second left prechamber passage 94 which has a U-shaped structure and directs the air back to an upward direction to the left heater 29.

The first right prechamber passage 92 has a first right prechamber indent 105, and the second right prechamber passage has a second right prechamber indent 106. Similarly, the second left prechamber passage 94 has a second left prechamber indent 107, and the first left prechamber passage 91 has a first left prechamber indent 108. The prechamber indents are cavities that are downwardly oriented and may potentially catch lose oil. Similarly, the bend back passages may also have a side indent that is oriented laterally at a 90° angle to the prechamber indents. The bend back passages may catch lose oil if the device is rotated by 90°. Therefore, the first right bend back passage 89 has a first right bend back passage indent, the second right bend back passage 95 has a second right bend back passage indent, the second left bend back passage 96 has a second left bend back passage indent, the first left bend back passage 90 has a first left bend back passage indent.

After that airflow passes through the heaters, the air from the right heater 28 passes through the right chimney passage 99, then the right chimney exit passage 101, and then exiting the right chimney exhaust 103, which would pass out of the right mouthpiece opening 18. Analogously, the left heater 29 exhausts vapor that passes through the left chimney passage 100, then exiting through the left chimney exit 102, and then exiting as the left chimney exhaust 104 which would pass out of the left mouthpiece opening 19.

During use, a user can use the right or left cartridge intermittently and alternatively. A user can put a first flavor in a first cartridge and a second flavor in a second cartridge for example. Thus, the user has the benefit of alternating flavor in a single device.

The invention claimed is:

1. An electronic vaporizer comprising:

an upper section, wherein the upper section comprises:

an upper housing;

a right cartridge, wherein the right cartridge is retained within the upper housing, wherein the right cartridge further includes a right heater, a right tank, and a right chimney;

a left cartridge, wherein the left cartridge is retained within the upper housing, wherein the left cartridge further includes a left heater, a left tank and a left chimney, wherein the left cartridge is parallel to the right cartridge;

a lower section, wherein the lower section comprises:

a lower housing; and a battery retained in the lower housing, wherein the battery is configured to activate the right heater and the left heater, wherein the right cartridge has a first right intake passage that extends upwardly, and a second right intake passage that extends upwardly, wherein the first right intake passage leads to a first right bend back passage which bends downwardly toward the right chimney, wherein the second right intake passage leads to a second right bend back passage which bends downwardly toward the right chimney, wherein the first right bend back passage leads to a first right pre-chamber passage, wherein the second right bend back passage leads to a second right prechamber passage, wherein the first right prechamber passage bends upwardly to the right chimney, wherein the second right prechamber passage bends upwardly to the right chimney.

2. The electronic vaporizer of claim 1, wherein the left cartridge has a first left intake passage that extends upwardly, and a second left intake passage that extends upwardly, wherein the first left intake passage leads to a first left bend back passage which bends downwardly toward the left chimney, wherein the second left intake passage leads to a second left bend back passage which bends downwardly toward the left chimney, wherein the first left bend back passage leads to a first left pre-chamber passage, wherein the second left bend back passage leads to a second left pre-chamber passage, wherein the first left prechamber passage bends upwardly to the left chimney, wherein the second left prechamber passage bends upwardly to the left chimney.

3. The electronic vaporizer of claim 2, further including a first right prechamber indent extending downwardly from the first right prechamber passage, and further including a second right prechamber indent extending downwardly from the second right prechamber passage.

4. The electronic vaporizer of claim 3, further including a first left prechamber indent extending downwardly from the first left prechamber passage, and further including a second left prechamber indent extending downwardly from the second left prechamber passage.

5. The electronic vaporizer of claim 2, further including a right airflow sensor, and a left airflow sensor, wherein the right airflow sensor and the left airflow sensor are mounted in the lower section.

6. The electronic vaporizer of claim 2, further including a USB port mounted to the lower housing, and further including a control button activating a control button switch mounted in the lower housing.

7. The electronic vaporizer of claim 2, further including an interface frame mounted to the lower section, wherein the interface frame retains a first right spring-loaded electrical contact, and a second right spring-loaded electrical contact, wherein the interface frame further retains a first a left spring loaded electrical contact, and a second left spring-loaded electrical contact.

8. The electronic vaporizer of claim 7, wherein the right cartridge has a first right cartridge contact making electrical contact to the first right spring-loaded electrical contact, and a second right cartridge contact making electrical contact to the second right spring-loaded electrical contact, wherein the left cartridge has a first left cartridge contact making electrical contact to the first left spring-loaded electrical contact, and a second left cartridge contact making electrical contact to the second left spring-loaded electrical contact.

9. The electronic vaporizer of claim 2, wherein the right cartridge fits into a right socket and wherein the left cartridge fits into a left socket, wherein the right socket and the left socket are formed in the upper housing.

10. The electronic vaporizer of claim 9, wherein the right socket has a right socket latch spring that retains the right cartridge at a right socket latch slot formed on the right cartridge, and wherein the left socket has a left socket latch spring that retains the left cartridge at a left socket latch slot formed on the left cartridge.

11. The electronic vaporizer of claim 10, wherein a right cartridge metal frame is attached to the right cartridge, and wherein a left cartridge metal frame is attached to the left cartridge, wherein the right cartridge metal frame releasably connects to a first right latch magnet, and a second right latch magnet, wherein the left cartridge metal frame releasably connects to a first left latch magnet and a second left latch magnet.

* * * * *